US010115509B2

(12) United States Patent
Ohta et al.

(10) Patent No.: US 10,115,509 B2
(45) Date of Patent: Oct. 30, 2018

(54) ULTRAFINE-CRYSTALLINE ALLOY RIBBON, FINE-CRYSTALLINE, SOFT-MAGNETIC ALLOY RIBBON, AND MAGNETIC DEVICE COMPRISING IT

(71) Applicant: HITACHI METALS, LTD., Tokyo (JP)

(72) Inventors: Motoki Ohta, Mishima-gun (JP); Yoshihito Yoshizawa, Mishima-gun (JP)

(73) Assignee: HITACHI METALS, LTD., Tokyo (JP)

( * ) Notice: Subject to any disclaimer, the term of this patent is extended or adjusted under 35 U.S.C. 154(b) by 267 days.

(21) Appl. No.: 14/426,866

(22) PCT Filed: Sep. 10, 2013

(86) PCT No.: PCT/JP2013/074351

§ 371 (c)(1),
(2) Date: Mar. 9, 2015

(87) PCT Pub. No.: WO2014/038705

PCT Pub. Date: Mar. 13, 2014

(65) Prior Publication Data

US 2015/0243421 A1 Aug. 27, 2015

(30) Foreign Application Priority Data

Sep. 10, 2012 (JP) ..... 2012-198087

(51) Int. Cl.
*H01F 1/153* (2006.01)
*C21D 6/00* (2006.01)
(Continued)

(52) U.S. Cl.
CPC ..... *H01F 1/15391* (2013.01); *B22D 11/0611* (2013.01); *C21D 6/00* (2013.01);
(Continued)

(58) Field of Classification Search
None
See application file for complete search history.

(56) References Cited

U.S. PATENT DOCUMENTS 8,177,923 B2 5/2012 Ohta et al.
8,182,620 B2 5/2012 Ohta et al.
(Continued)

FOREIGN PATENT DOCUMENTS

JP 08-283920 A 10/1996
JP WO 2011122589 A1 * 10/2011 ..... C21D 8/1211
(Continued)

OTHER PUBLICATIONS

Ohta-2 (Applied Physics Express, 2009, vol. 2, 023005).*
International Search Report of PCT/JP2013/074351 dated Dec. 17, 2013.

*Primary Examiner* — Xiaowei Su
(74) *Attorney, Agent, or Firm* — Sughrue Mion, PLLC

(57) ABSTRACT

An ultrafine-crystalline alloy ribbon having a composition represented by the general formula of $Fe_{100-x-y-z}A_xB_yX_z$, wherein A is Cu and/or Au, X is at least one element selected from the group consisting of Si, S, C, P, Al, Ge, Ga and Be, and x, y and z are numbers meeting the conditions of $0<x\leq5$, $8\leq y\leq22$, $0\leq z\leq10$, and $x+y+z\leq25$ by atomic %, and a structure in which ultrafine crystal grains having an average particle size of 30 nm or less being dispersed in a proportion of more than 0% and less than 30% by volume in an amorphous matrix; an ultrafine crystal grains-depleted region comprising ultrafine crystal grains at a number density of less than 500/μm$^2$ being formed in a region of 0.2 mm in width from each side of the ribbon.

6 Claims, 6 Drawing Sheets

(51) Int. Cl.

| | |
|---|---|
| ***C22C 45/02*** | (2006.01) |
| ***B22D 11/06*** | (2006.01) |
| ***C22C 33/00*** | (2006.01) |
| ***C22C 38/00*** | (2006.01) |
| ***C22C 38/02*** | (2006.01) |
| ***C22C 38/16*** | (2006.01) |
| ***C22C 38/06*** | (2006.01) |

(52) U.S. Cl.

CPC ..... *C22C 33/003* (2013.01); *C22C 38/002* (2013.01); *C22C 38/02* (2013.01); *C22C 38/06* (2013.01); *C22C 38/16* (2013.01); *C22C 45/02* (2013.01); *H01F 1/15333* (2013.01); *C21D 2201/03* (2013.01)

(56) References Cited

U.S. PATENT DOCUMENTS

| | | | | |
|---|---|---|---|---|
| 8,287,666 | B2 | 10/2012 | Ohta et al. | |
| 2009/0266448 | A1 | 10/2009 | Ohta et al. | |
| 2011/0085931 | A1 | 4/2011 | Ohta et al. | |
| 2011/0108167 | A1 | 5/2011 | Ohta et al. | |
| 2012/0318412 | A1* | 12/2012 | Ohta ..... | C21D 8/1211 148/548 |
| 2014/0191832 | A1 | 7/2014 | Ohta et al. | |

FOREIGN PATENT DOCUMENTS

| | | | |
|---|---|---|---|
| WO | 2007/032531 | A1 | 3/2007 |
| WO | 2011/122589 | A1 | 10/2011 |
| WO | 2013/051380 | A1 | 4/2013 |

* cited by examiner

ULTRAFINE-CRYSTALLINE ALLOY RIBBON, FINE-CRYSTALLINE, SOFT-MAGNETIC ALLOY RIBBON, AND MAGNETIC DEVICE COMPRISING IT

CROSS REFERENCE TO RELATED APPLICATIONS

This is a National Stage of International Application No. PCT/JP2013/074351 filed Sep. 10, 2013(claiming priority based on Japanese Patent Application No. 2012-198087 filed Sep. 10, 2012), the contents of which are incorporated herein by reference in their entirety.

FIELD OF THE INVENTION

The present invention relates to an ultrafine-crystalline alloy ribbon which can be wound and rewound without fracture, a fine-crystalline, soft-magnetic alloy ribbon obtained by heat-treating it, and a magnetic device comprising the fine-crystalline, soft-magnetic alloy ribbon.

BACKGROUND OF THE INVENTION

Soft-magnetic materials used for various reactors, choke coils, pulse power magnetic devices, antennas, cores of transformers, motors and power generators, current sensors, magnetic sensors, electromagnetic wave-absorbing sheets, etc. include silicon steel, ferrite, Co-based, amorphous, soft-magnetic alloys, Fe-based, amorphous, soft-magnetic alloys, and Fe-based, fine-crystalline, soft-magnetic alloys. Though silicon steel is inexpensive and has a high magnetic flux density, it suffers large loss at high frequencies, and is difficult to be made thin. Because ferrite has a low saturation magnetic flux density, it is easily saturated magnetically in high-power applications operable with large magnetic flux densities. Because the Co-based, amorphous, soft-magnetic alloys are expensive and have as low saturation magnetic flux densities as 1T or less, parts made of them for high-power applications are inevitably large, and their loss increases with time due to thermal instability. Though the Fe-based, amorphous, soft-magnetic alloys have as high saturation magnetic flux densities as about 1.5T, they are not sufficient, and their coercivity is not sufficiently low.

On the other hand, the Fe-based, fine-crystalline, soft-magnetic alloys have high saturation magnetic flux densities and excellent soft-magnetic properties. An example of Fe-based, fine-crystalline, soft-magnetic alloys is disclosed in WO 2007/032531. This Fe-based, fine-crystalline, soft-magnetic alloy has a composition represented by the formula of $Fe_{100-x-y-z}Cu_xB_yX_z$, wherein X is at least one element selected from the group consisting of Si, S, C, P, Al, Ge, Ga and Be, and x, y and z are numbers meeting the conditions of $0.1 \le x \le 3$, $8 \le y \le 20$, $0 < z \le 10$, and $10 < y+z \le 24$ by atomic %, and a structure comprising crystal grains having an average particle size of 60 nm or less dispersed in a proportion of 30% or more by volume in an amorphous matrix; and having as high saturation magnetic flux density as 1.7 T or more and low coercivity.

This Fe-based, fine-crystalline, soft-magnetic alloy is produced by quenching an Fe-based alloy melt to form an ultrafine-crystalline alloy ribbon comprising fine crystal grains having an average particle size of 30 nm or less dispersed in a proportion of less than 30% by volume in an amorphous matrix, and subjecting this ultrafine-crystalline alloy ribbon to a high-temperature, short-time heat treatment or a low-temperature, long-time heat treatment. The quenched alloy ribbon is peeled from a cooling roll, wound around a reel with its tip end attached thereto, and if necessary, rewound.

Though ultrafine-crystalline alloy ribbons inherently have poor windability because of low toughness and thus easy fracture, they should be wound to a neatly laminated coil shape in mass production. To this end, reels with flanges are used. It has been found, however, that side portions of the ribbon come into contact with flanges of a winding reel in rewinding, making it likely that the ultrafine-crystalline alloy ribbon is frequently fractured. Such problems do not occur in amorphous alloy ribbons having relatively high toughness.

OBJECTS OF THE INVENTION

Accordingly, an object of the present invention is to provide an ultrafine-crystalline alloy ribbon, which can be wound and rewound without frequent fracture even when a conventional winding reel with flanges is used.

Another object of the present invention is to provide a fine-crystalline, soft-magnetic alloy ribbon obtained from this ultrafine-crystalline alloy ribbon, which has a high saturation magnetic flux density and excellent soft-magnetic properties.

A further object of the present invention is to provide a magnetic device comprising the above fine-crystalline, soft-magnetic alloy ribbon.

DISCLOSURE OF THE INVENTION

As a result of intensive research in view of the above objects, the inventors have found that in the production of an ultrafine-crystalline alloy ribbon by a liquid-quenching method, the formation of ultrafine crystal grains-depleted regions having a lower number density of ultrafine crystal grains in both side portions enables the ultrafine-crystalline alloy ribbon to exhibit sufficient fracture resistance due to the toughness of the ultrafine crystal grains-depleted regions, thereby extremely lowering the frequency of fracture due to contact with the reel flanges. The present invention has been completed based on such finding.

Thus, the ultrafine-crystalline alloy ribbon of the present invention has a structure, in which ultrafine crystal grains having an average particle size of 30 nm or less are dispersed in a proportion of more than 0% and less than 30% by volume in an amorphous matrix; an ultrafine crystal grains-depleted region having a smaller number density of ultrafine crystal grains than in a center portion of the ribbon being formed in a region of 0.2 mm in width from each side of the ribbon; and the number density of ultrafine crystal grains having particle sizes of 3 nm or more being less than $500/\mu m^2$ in the ultrafine crystal grains-depleted region.

In the ultrafine crystal grains-depleted regions, the number density of ultrafine crystal grains having particle sizes of 3 nm or more is preferably $100/\mu m^2$ or less. In a center portion other than the ultrafine crystal grains-depleted regions, the number density of ultrafine crystal grains having particle sizes of 3 nm or more is preferably $500/\mu m^2$ or more. The upper limit of the number density of ultrafine crystal grains in the center portion is preferably $3000/\mu m^2$.

The total width of both ultrafine crystal grains-depleted regions is preferably 5% or less of the entire width of the ultrafine-crystalline alloy ribbon.

The ribbon is preferably made of a magnetic alloy having a composition represented by the general formula of $Fe_{100-x-y-z}A_xB_yX_z$, wherein A is Cu and/or Au, X is at least one element selected from the group consisting of Si, S, C, P, Al, Ge, Ga and Be, and x, y and z are numbers meeting the conditions of $0<x\leq5$, $8\leq y\leq22$, $0\leq z\leq10$, and $x+y+z\leq25$ by atomic %.

The fine-crystalline, soft-magnetic alloy ribbon of the present invention, which is obtained by heat-treating the above ultrafine-crystalline alloy ribbon, has a structure, in which fine crystal grains having an average particle size of 60 nm or less are dispersed in a proportion of 30% or more by volume in an amorphous matrix; grain-grown regions comprising fine crystal grains having larger particle sizes than the average particle size being formed in both side portions; and the total width of both grain-grown regions being 5% or less of the entire width of the fine-crystalline, soft-magnetic alloy ribbon.

The magnetic device of the present invention comprises the above fine-crystalline, soft-magnetic alloy ribbon.

DESCRIPTION OF THE PREFERRED EMBODIMENTS

Figure 1:
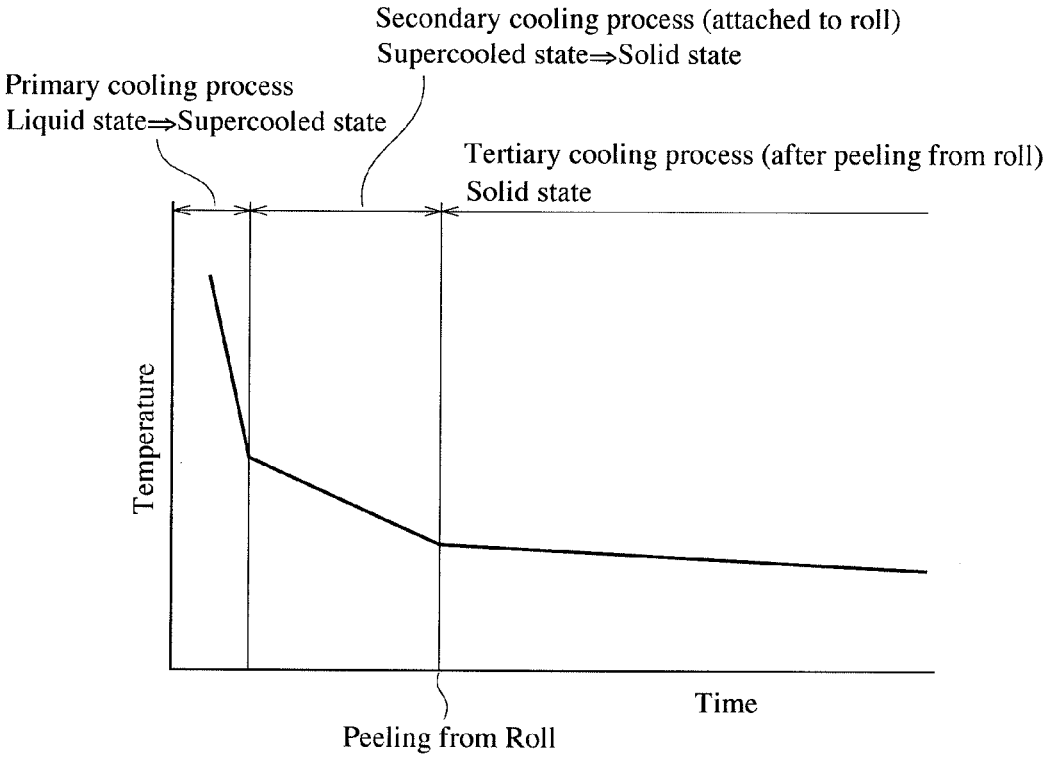
FIG. 1 is a graph showing a cooling process in a liquid-quenching method using a single roll.
Figure 2:
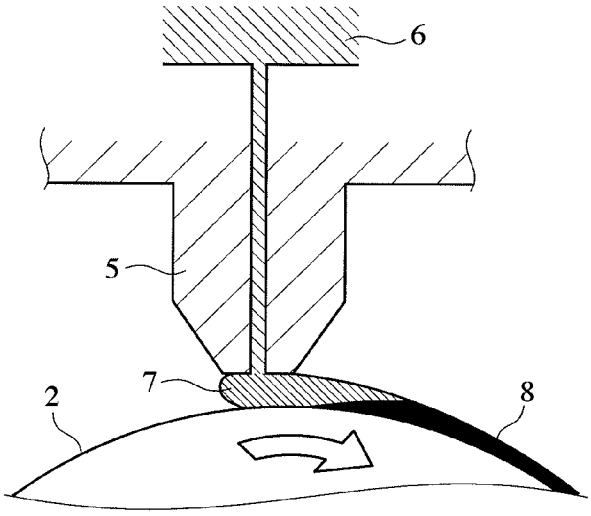
FIG. 2 is a schematic view showing a puddle of an alloy melt ejected onto a cooling roll in a liquid-quenching method.

[1] Ultrafine-Crystalline Alloy Ribbon (1) Ultrafine Crystal Grains-Depleting Region FIG. 1 shows the cooling process of a melt (change of a phase) by a single-roll method, and FIG. 2 shows the change of a melt from a liquid phase to a solid phase on a cooling roll. In a liquid-quenching method, preferably in a single-roll method, a melt 6 ejected from a nozzle 5 onto a cooling roll 2 keeps a liquid state (stayed in a melt state) as a puddle 7 for about $10^{-8}$ to $10^{-6}$ seconds, and then rapidly cooled by the cooling roll 2 to a supercooled state (primary cooling process). Because of cooling in an extremely short period of time, a ribbon 8 (solid phase) obtained is not in a crystal state having atoms regularly arranged, but in an amorphous state having atoms randomly arranged. In a solid phase, a secondary cooling process occurs with a low cooling speed. In the secondary cooling process, Cu atoms insoluble in Fe—B are aggregated to form Cu clusters, which act as nuclei for forming ultrafine crystal grains. Thereafter the ribbon 8 is peeled from the cooling roll 2, to obtain an ultrafine-crystalline alloy ribbon through a tertiary cooling process.

The ultrafine-crystalline alloy ribbon is heat-treated to accelerate the growth of ultrafine crystal grains, thereby obtaining an fine-crystalline, soft-magnetic alloy ribbon comprising 30% or more by volume of fine crystal grains having an average particle size of 60 nm or less, which are dispersed in an amorphous matrix. The term "ultrafine crystal grains" used herein means crystal nuclei precipitated in an amorphous matrix of an ultrafine-crystalline alloy obtained by quenching an alloy melt, and the term "fine crystal grains" means crystal grains grown from the ultrafine crystal grains by heat treatment.

The soft-magnetic properties of the fine-crystalline, soft-magnetic alloy ribbon is influenced by the particle size and volume fraction of fine crystal grains, which can be adjusted to some extent by a heat treatment process. What is important to obtain desired particle size and volume fraction is to adjust the number density of ultrafine crystal grains in the secondary cooling process. With respect to the ultrafine crystal grains and the fine crystal grains, the "volume fraction" is determined from a photomicrograph by a lineal intercept method, and the "number density" is the number of crystal grains counted per a unit area on a photomicrograph.

As described above, Cu clustering occurs in the secondary cooling process, and the number density of ultrafine crystal grains changes depending on the cooling speed particularly in a range of about 300-500° C. It has conventionally been considered desirable that the number density of ultrafine crystal grains is uniform in the entire ribbon. However, an ultrafine-crystalline alloy ribbon containing ultrafine crystal grains has low toughness, likely suffering fracture at the time of winding and rewinding. Paying attention to the fact that the starting points of fracture are substantially in both side portions, intensive research has revealed that the reduction of the number density of ultrafine crystal grains in side portions, namely the formation of ultrafine crystal grains-depleted regions in side portions, makes it possible to prevent fracture at the time of winding and rewinding. The ultrafine crystal grains-depleted region has a structure close to an amorphous phase, preferably having a substantially amorphous phase.

Figure 3:
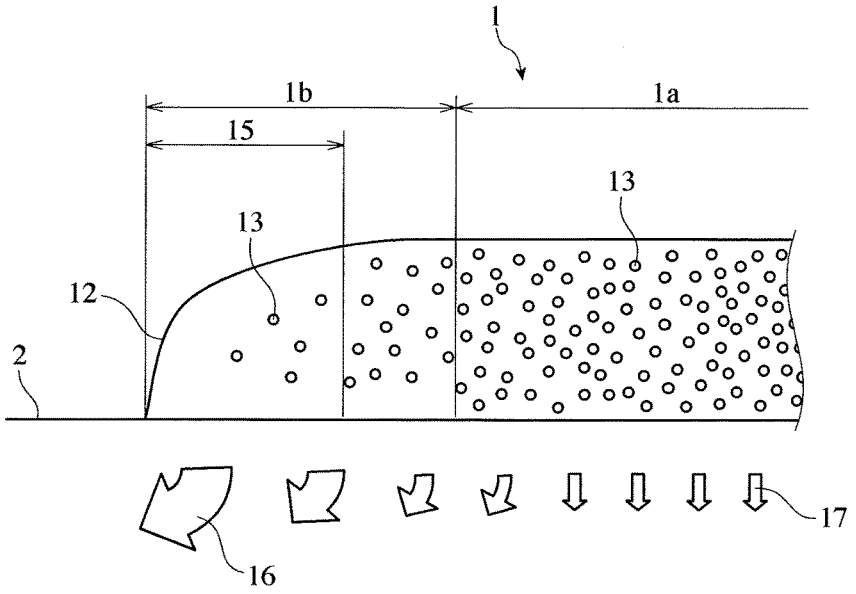
FIG. 3 is an enlarged view showing the details of an alloy melt puddle.
Figure 4:
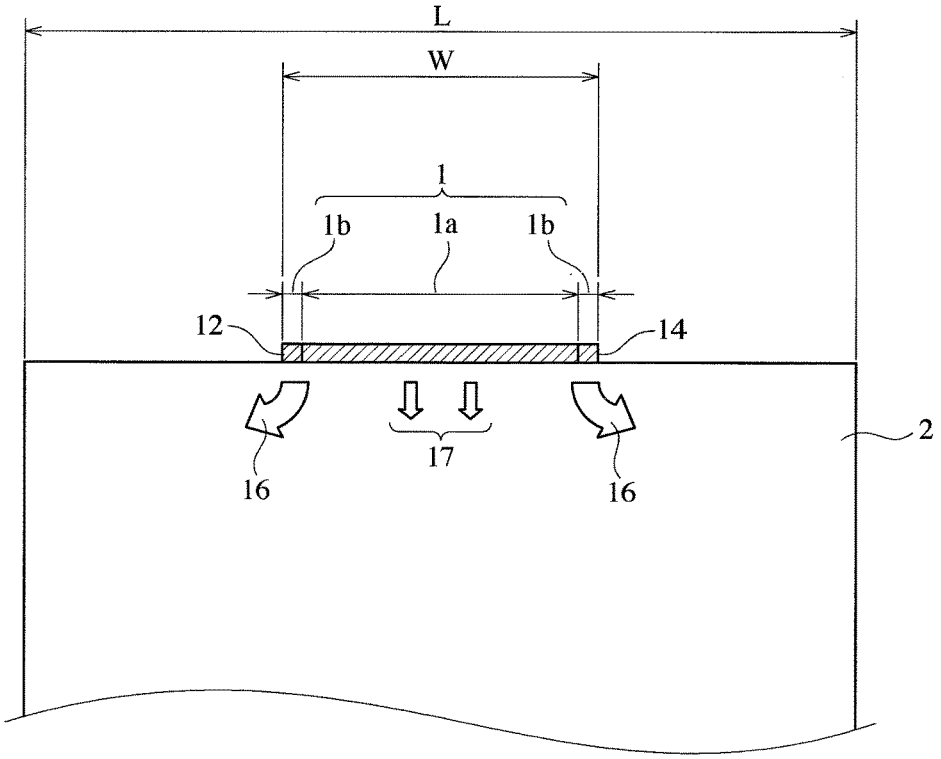
FIG. 4 is a partial cross-sectional view showing an ultrafine-crystalline alloy ribbon formed in a center portion of a cooling roll.

A high cooling speed (good cooling efficiency) forms an amorphous phase, resulting in a low number density of ultrafine crystal grains. As shown in FIGS. 3 and 4, to have a higher cooling speed in regions 1*b*, 1*b* near both sides 12, 14 of the ultrafine-crystalline alloy ribbon 1 than in a center portion 1*a*, both near-side regions 1*b*, 1*b* are preferably thinner than the center portion 1*a*. FIG. 3 shows the conduction of heat when both near-side regions 1*b*, 1*b* are thinner than the center portion 1*a*. The thickness of each arrow 16, 17 indicates the amount of heat conducted, and the direction of each arrow 16, 17 indicates the direction of heat conduction. Because cooling efficiency is higher in both near-side regions 1*b*, 1*b* of the ultrafine-crystalline alloy ribbon 1 than in the center portion 1*a*, heat conduction from the ribbon 1 to the to cooling roll 2 is more in the near-side regions 1*b*, 1*b* than in the center portion la as shown in the arrows 16, 17, so that the near-side regions 1*b*, 1*b* are cooled faster than the center portion 1*a*. As a result, the number density of ultrafine crystal grains 13 is lower in the near-side regions 1*b*, 1*b* than in the center portion.

Because the width of each region 1*b*, 1*b* having a reduced number density of ultrafine crystal grains is not necessarily constant in a longitudinal direction, a region 15 of 0.2 mm in width from each side 12, 14 within the region 1*b*, 1*b*, in which decrease in the number density of ultrafine crystal grains is clearly observed, is defined as an "ultrafine crystal grains-depleted region." To secure toughness necessary for mass production, the number density of ultrafine crystal grains 13 having particle sizes of 3 nm or more (confirmed by the naked eye in a TEM photograph having magnification of 20,000 times) should be less than 500/$\mu m^2$ in the ultrafine crystal grains-depleted region 15. A structure comprising ultrafine crystal grains 13 at a number density of less than 500/$\mu m^2$ has toughness substantially close to that of an amorphous phase. Because the ultrafine crystal grains-depleted region 15 is formed substantially continuously in a longitudinal direction in the ultrafine-crystalline alloy ribbon, the ultrafine-crystalline alloy ribbon has improved fracture resistance.

In the ultrafine crystal grains-depleted region 15 having a reduced number density of ultrafine crystal grains, grain growth easily occurs by heat treatment. Accordingly, the ultrafine crystal grains-depleted region 15 becomes a "grain-grown region" after heat treatment. Coarse crystal grains reduce magnetic saturability in a low magnetic field. Paying attention to a ratio $B_{80}/B_{8000}$, in which $B_{80}$ is a magnetic flux density in a low magnetic field (80 A/m), and $B_{8000}$ is a magnetic flux density in a high magnetic field (8000 A/m) (substantially equal to a saturation magnetic flux density $B_s$), $B_{80}/B_{8000}$ tends to become smaller as crystal grains become coarser. $B_{800}/B_{8000}$ is substantially equal to $B_{80}/B_S$. When regions with poor magnetic saturability are 5% or less of the entire ribbon, $B_{80}/B_{8000}$ is as high as 95%, indicating that the ribbon has good magnetic saturability. Accordingly, when the total width of the ultrafine crystal grains-depleted regions 15 is 5% or less of the entire width of the ribbon, the ribbon has magnetic saturability within an acceptable range. For example, when the ribbon is as wide as 25 mm, the width of each ultrafine crystal grains-depleted region (grain-grown region) 15 may be 25×0.05/2=0.625 mm or less. A percentage of the total width of the grain-grown regions to the entire width of the ribbon is preferably 4% or less, more preferably 2% or less. With the grain-grown regions having such width, the ribbon has improved fracture resistance (toughness) necessary for rewinding, etc., while securing enough magnetic saturability at low frequencies.

(2) Structure

The ultrafine-crystalline alloy ribbon has a structure, in which ultrafine crystal grains having an average particle size of 30 nm or less are dispersed in a proportion of more than 0% and 30% or less by volume in an amorphous matrix. When the ultrafine crystal grains have an average particle size of more than 30 nm, fine crystal grains become coarse after heat treatment, resulting in poor soft-magnetic properties. The lower limit of the average particle size of ultrafine crystal grains is about 0.5 nm from the measurement limit, and it is preferably 1 nm or more, more preferably 2 nm or more. To obtain excellent soft-magnetic properties, the average particle size of ultrafine crystal grains is preferably 5-25 nm, more preferably 5-20 nm. In the Ni-containing composition, the average particle size of ultrafine crystal grains is preferably about 5-15 nm. The volume fraction of ultrafine crystal grains is more than 0% by volume in the ultrafine-crystalline alloy ribbon. With a volume fraction exceeding 30% by volume, however, the average particle size of ultrafine crystal grains tends to be more than 30 nm, providing the ribbon with such insufficient toughness that it cannot easily be handled in subsequent steps. On the other hand, without ultrafine crystal grains (if completely amorphous), coarse crystal grains would be easily formed by a heat treatment. The volume fraction of ultrafine crystal grains is preferably 5-30%, more preferably 10-25%, in the ultrafine-crystalline alloy ribbon.

When an average distance between ultrafine crystal grains (average distance between their centers of gravity) is 50 nm or less, the magnetic anisotropy of fine crystal grains is preferably averaged, resulting in reduced effective crystal magnetic anisotropy. When the average distance is more than 50 nm, the magnetic anisotropy is less averaged, resulting in high effective crystal magnetic anisotropy and poor soft-magnetic properties.

(3) Composition

A magnetic alloy used in the present invention preferably has a composition represented by the general formula of $Fe_{100-x-y-z}A_xB_yX_z$, wherein A is Cu and/or Au, X is at least one element selected from the group consisting of Si, S, C, P, Al, Ge, Ga and Be, and x, y and z are numbers meeting the conditions of $0<x\leq5$, $8\leq y\leq22$, $0\leq z\leq10$, and $x+y+z\leq25$ by atomic %. Of course, the magnetic alloy may contain inevitable impurities. To have a saturation magnetic flux density Bs of 1.7 T or more, it has a fine-crystalline (nano-crystalline) structure of bcc-Fe. To obtain this structure, the Fe content should be high. Specifically, the Fe content is 75 atomic % or more, preferably 77 atomic % or more, more preferably 78 atomic % or more.

When $0.1\leq x\leq3$, $10\leq y\leq20$, $0\leq z\leq10$, and $10<y+z\leq24$, in the above composition range, the saturation magnetic flux density Bs is 1.7 T or more. When $0.1\leq x\leq3$, $12\leq y\leq17$, $0<z\leq7$, and $13\leq y+z\leq20$, the saturation magnetic flux density Bs is 1.74 T or more. Also, when $0.1\leq x\leq3$, $12\leq y\leq15$, $0<z\leq5$, and $14\leq y+z\leq19$, the saturation magnetic flux density Bs is 1.78 T or more. Further, when $0.1\leq x\leq3$, $12\leq y\leq15$, $0<z\leq4$, and $14\leq y+z\leq17$, the saturation magnetic flux density Bs is 1.8 T or more. With the preferred composition ranges of elements described below, the soft-magnetic properties and productivity can be improved.

To have good soft-magnetic properties, specifically coercivity of 24 A/m or less, preferably 12 A/m or less, and a saturation magnetic flux density Bs of 1.7 T or more, the ultrafine-crystalline alloy contains a nucleus-forming element A (Cu and/or Au) insoluble in Fe, in an Fe—B-based basic composition stably providing an amorphous phase even at a high Fe content. Specifically, Cu and/or Au insoluble in Fe are added to an Fe—B-based alloy containing 88 atomic % or less of Fe, which stably provides a main amorphous phase, to precipitate ultrafine crystal grains. The ultrafine crystal grains uniformly grow by a subsequent heat treatment.

When the amount x of the element A is too little, the precipitation of ultrafine crystal grains is difficult. With more than 5 atomic % of the element A, quenching provides a brittle ribbon having an amorphous phase as a main phase. From the aspect of cost, the element A is preferably Cu. Because soft-magnetic properties tend to be poor with more than 3 atomic % of Cu, the amount x of Cu contained is preferably 0.3-2 atomic %, more preferably 1-1.7 atomic %, most preferably 1.2-1.6 atomic %. When Au is contained, it is preferably 1.5 atomic % or less.

B (boron) is an element promoting the formation of an amorphous phase. Less than 8 atomic % of B makes it difficult to obtain an ultrafine-crystalline alloy ribbon having an amorphous phase as a main phase, and more than 22 atomic % of B provides an alloy ribbon with a saturation magnetic flux density of less than 1.7 T. Accordingly, the amount y of B contained should meet the condition of $8\leq y\leq22$. The amount y of B contained is preferably 11-20 atomic %, more preferably 12-18 atomic %, most preferably 12-17 atomic %.

The element X is at least one element selected from the group consisting of Si, S, C, P, Al, Ge, Ga and Be, particularly Si. Because the addition of the element X makes higher a temperature of precipitating Fe—B or Fe—P (when P is added) having large crystal magnetic anisotropy, a heat treatment temperature can be elevated. A high-temperature heat treatment increases the percentage of fine crystal grains, resulting in increased Bs, and improved squareness of a B—H curve, while suppressing the degeneration or discoloration of a ribbon surface. Though the lower limit of the amount z of the element X may be 0 atomic %, 1 atomic % or more of the element X can form an oxide layer of the element X on the ribbon surface, sufficiently suppressing the oxidation of the ribbon. When the amount z of the element X exceeds 10 atomic %, Bs becomes less than 1.7 T. The amount z of the element X is preferably 2-9 atomic %, more preferably 3-8 atomic %, most preferably 4-7 atomic %.

Among the element X, P is an element improving the capability of forming an amorphous phase, suppressing the growth of fine crystal grains, and the segregation of B to an oxide coating. Thus, P is preferable to achieve high toughness, high Bs and good soft-magnetic properties. When S, C, Al, Ge, Ga or Be is used as the element X, magnetostriction and magnetic properties can be adjusted.

Part of Fe may be substituted by at least one element D selected from the group consisting of Ni, Mn, Co, V, Cr, Ti, Zr, Nb, Mo, Hf, Ta and W. The amount of the element D contained is preferably 0.01-10 atomic %, more preferably 0.01-3 atomic %, most preferably 0.01-1.5 atomic %. Among the element D, Ni, Mn, Co, V and Cr have an effect of moving a high-B-concentration region toward the surface, providing a near-surface region with a structure close to the matrix, thereby improving the soft-magnetic properties (magnetic permeability, coercivity, etc.) of the soft-magnetic alloy ribbon. Because the element D predominantly enters an amorphous phase remaining after a heat treatment together with such metalloid elements as the element A, B, Si, etc., it suppresses the growth of fine crystal grains having a high Fe content, to reduce their average particle size, thereby improving the saturation magnetic flux density Bs and the soft-magnetic properties.

Particularly when part of Fe is substituted by Co or Ni soluble in Fe together with the element A, the amount of the element A that can be added increases to make a crystal structure finer, thereby improving soft-magnetic properties. The amount of Ni is preferably 0.1-2 atomic %, more preferably 0.5-1 atomic %. Less than 0.1 atomic % of Ni provides an insufficient effect of improving handleability (cuttability and windability), and more than 2 atomic % of Ni reduces $B_sB_{80}$ and $H_c$. The amount of Co is preferably 0.1-2 atomic %, more preferably 0.5-1 atomic %.

Ti, Zr, Nb, Mo, Hf, Ta and W also predominantly enter an amorphous phase remaining after a heat treatment together with the element A and metalloid elements, contributing to improvement in a saturation magnetic flux density Bs and soft-magnetic properties. On the other hand, when these elements having large atomic weights are too much, the amount of Fe per a unit weight is low, resulting in poor soft-magnetic properties. The total amount of these elements is preferably 3 atomic % or less. Particularly in the case of Nb and Zr, their total amount is preferably 2.5 atomic % or less, more preferably 1.5 atomic % or less. In the case of Ta and Hf, their total amount is preferably 1.5 atomic % or less, more preferably 0.8 atomic % or less.

Part of Fe may be substituted by at least one element selected from the group consisting of Re, Y, Zn, As, Ag, In, Sn, Sb, platinum-group elements, Bi, N, O, and rare earth elements. The total amount of these elements is preferably 5 atomic % or less, more preferably 2 atomic % or less. To obtain a particularly high saturation magnetic flux density, the total amount of these elements is preferably 1.5 atomic % or less, more preferably 1.0 atomic % or less.

[2] Production Method of Ultrafine-Crystalline Alloy Ribbon (1) Alloy Melt

An alloy melt used for the ultrafine-crystalline alloy ribbon preferably has a composition represented by the above the general formula of $Fe_{100-x-y-z}A_xB_yX_z$, wherein A is Cu and/or Au, X is at least one element selected from the group consisting of Si, S, C, P, Al, Ge, Ga and Be, and x, y and z are numbers meeting the conditions of $0<x\leq5$, $8\leq y\leq22$, $0\leq z\leq10$, and $x+y+z\leq25$ by atomic %. Taking for example a case where the element A is Cu in the above composition, a method for producing an ultrafine-crystalline alloy ribbon by a single-roll method will be explained in detail below, of course without intention of restricting the present invention thereto.

(2) Quenching of Melt

In the case of quenching by a single-roll method, the temperature of the alloy melt is preferably higher than the melting point of the alloy by 50-300° C. For example, in the case of producing a ribbon of several tens of micrometers in thickness in which ultrafine crystal grains are precipitated, a melt at about 1300-1400° C. is preferably ejected from a nozzle onto a cooling roll. An atmosphere in the single-roll method is air or an inert gas (Ar, nitrogen, etc.) when the alloy does not contain an active metal, or an inert gas (Ar, He, nitrogen, etc.) or vacuum when it contains an active metal. To form an oxide coating on the surface, the quenching of a melt is conducted preferably in an oxygen-containing atmosphere (for example, air).

Materials for the cooling roll are suitably high-thermal-conductivity, pure copper, or copper alloys such as Cu—Be, Cu—Cr, Cu—Zr, Cu—Zr—Cr, etc. In the case of mass production, or in the case of producing thick and/or wide ribbons, the cooling roll is preferably cooled with water. Because the cooling of the roll with water affects the volume fraction of ultrafine crystal grains, it is effective to keep the cooling capability of the cooling roll, which may be called "cooling speed," from the start to end of casting. Because the cooling capability of the cooling roll is correlated with the temperature of cooling water in a mass production line, it is effective to keep the cooling water at a predetermined temperature or higher.

(3) Width and Position of Ultrafine-Crystalline Alloy Ribbon on Cooling Roll

To form ultrafine crystal grains with a sufficient number density in a center portion of the ultrafine-crystalline alloy ribbon, and ultrafine crystal grains-depleted regions 15 with a low number density in both side portions, it is necessary (a) to optimize the cooling conditions (a material for the cooling roll, the structure of cooling water paths, the amount of cooling water, etc.) affecting the volume fraction of ultrafine crystal grains, and (b) to optimize the relation between a cooling roll width and a ribbon width, and the position of the ribbon on the cooling roll.

Figure 6:
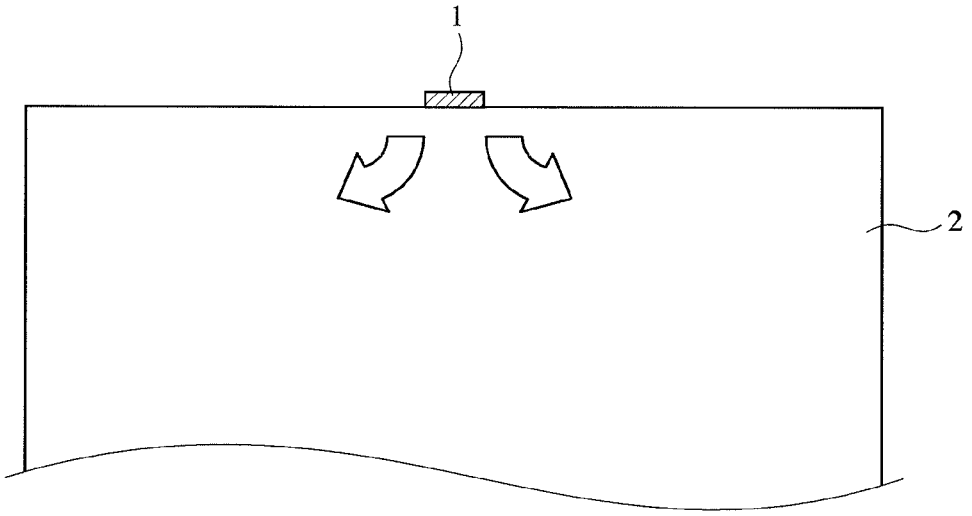
FIG. 6 is a partial cross-sectional view showing a too narrow ultrafine-crystalline alloy ribbon relative to the width of a cooling roll.

In a center portion of the ultrafine-crystalline alloy ribbon, the ribbon should be exposed to a temperature of 300° C. to 500° C. for 0.01 second or more in the secondary cooling process. When the ribbon temperature is lower than the above temperature range before the secondary cooling process, or when the cooling time is shorter than described above, too rapid quenching takes place, resulting in a low number density of ultrafine crystal grains. This occurs when the cooling roll is too wide relative to the ribbon as shown in FIG. 6. With too low a number density of ultrafine crystal grains in a center portion of the ribbon, the entire ribbon has insufficient soft-magnetic properties.

Figure 5:
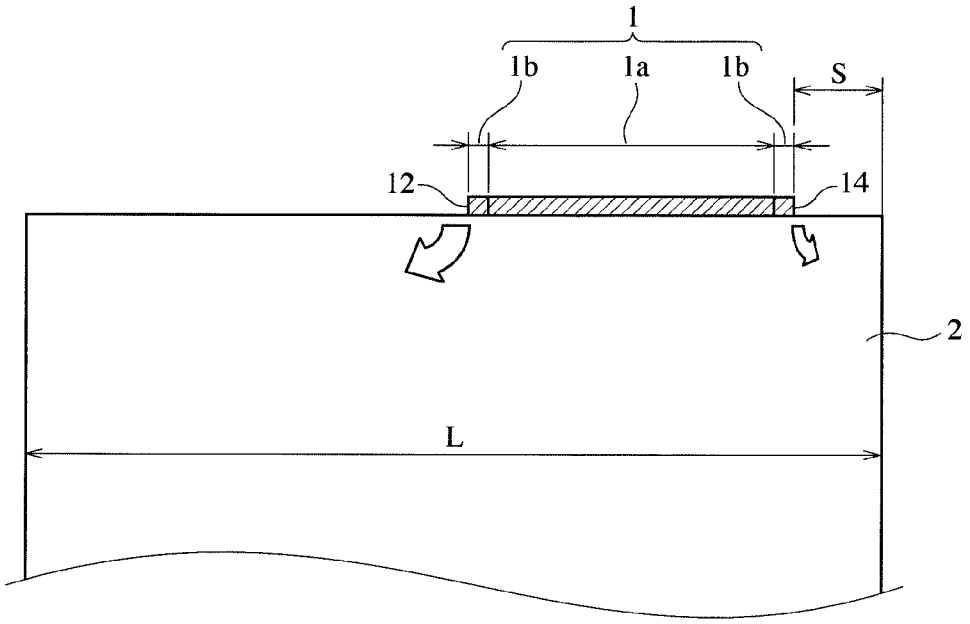
FIG. 5 is a partial cross-sectional view showing an ultrafine-crystalline alloy ribbon formed near a side of a cooling roll.

When a ribbon 1 having a proper width is located substantially in a center region of the cooling roll 2 as shown in FIG. 4, heat conduction shown in FIG. 3 occurs, so that regions 1*b*, 1*b* having a low number density of ultrafine crystal grains are formed near both sides 12, 14 of the ribbon 1. The ultrafine crystal grains-depleted region 15 is located in each region 1*b*,1*b*. When a ribbon 1 of the same width is placed closer to one side of the cooling roll 2 as shown in FIG. 5, a good ultrafine crystal grains-depleted region cannot be obtained in a side portion 14 of the ribbon close to one side of the cooling roll 2. It is thus important to adjust the distance S between each side 12, 14 of the ribbon 1 and the corresponding side of the cooling roll 2 (a shorter distance when there are different distances S on both sides of the ribbon). Because a surface state of the cooling roll 2 changes as casting is repeated, casting is conducted at different positions of the cooling roll 2 to avoid influence by this change. Accordingly, a casting width (width of an entire casting region) on the cooling roll 2 is larger than the width of the ribbon 1. Accordingly, the distance S is not simply determined from the width L of the cooling roll 2 and the width W of the ribbon 1, but determined taking the casting width into consideration. In other words, the width L of the cooling roll 2 is determined depending on the width W of a ribbon 1 to be produced, and necessary distance S and casting width.

Intensive research has revealed that when a ribbon 1 has a width W of 5-250 mm, which is 50% or less of the width L of a cooling roll 2, and when with the distance S is 30-150 mm, a 1-mm-wide region extending from each side 12, 14 of the ribbon 1 is cooled about 100-300° C. lower than in a center portion of the ribbon in the primary cooling process, resulting in a good ultrafine crystal grains-depleted region 15. In the case of a ribbon 1 having a width W of 5-250 mm, which is more than 50% of the width L of the cooling roll 2, temperature elevation is remarkable in the entire cooling roll 2, so that the distance S should be 50-200 mm.

When the width L of the cooling roll 2 is too large relative to the width W of the ribbon 1 as shown in FIG. 6, even a center portion of the ribbon 1 is quenched too rapidly, resulting in a low number density of ultrafine crystal grains. On the other hand, when the ribbon 1 is too wide relative to the cooling roll 2, a sufficient distance S cannot be obtained. Accordingly, the width W of the ribbon 1 is preferably 5-75% of the width L of the cooling roll 2.

(4) Adjustment of Gap

In the casting of a ribbon by a single-roll method, the thickness, cross section shape, surface undulation, etc. of the ribbon can be controlled by adjusting the puddle. To adjust the puddle, the control of a distance (gap) between the nozzle and the cooling roll, and the adjustment of the pressure and weight of an ejected melt are effective. Because the pressure and weight of an ejected melt may change depending on parameters such as the remaining amount and temperature of the melt, their control is difficult. On the contrary, the gap can be relatively easily adjusted by always monitoring the distance between the cooling roll and the nozzle, and feedbacking it. Accordingly, it is preferable to control the thickness, cross section shape, surface undulation, etc. of the ultrafine-crystalline alloy ribbon by adjusting the gap.

In general, a wider gap provides a better melt flow, effective for making the ribbon 1 thicker and preventing the puddle from collapsing. However, too wide a gap provides the ribbon 1 with a semioval cross section having a thicker center portion and thinner side portions, generating a cooling speed difference due to the thickness difference, and thus precipitating different amounts of ultrafine crystal grains. To form good ultrafine crystal grains-depleted regions in both side portions, the gap is preferably as relatively wide as 150-400 μm, with a low ejecting pressure of an alloy melt onto the cooling roll 2. The gap is more preferably 200-300 μm.

(5) Peripheral Speed of Cooling Roll

To control the cooling speed of the ribbon 1, which has a close relation to the formation of ultrafine crystal grains, the peripheral speed of the cooling roll 2 is preferably controlled. A higher peripheral speed of the cooling roll 2 provides a smaller number of ultrafine crystal grains, and a lower peripheral speed increases ultrafine crystal grains. To promote the formation of ultrafine crystal grains in a center portion 1*a* of the ribbon 1, the peripheral speed of the cooling roll is preferably 15-50 m/s, more preferably 20-40 m/s, most preferably 25-35 m/s. It has been found that the peripheral speed of the cooling roll 2 affects the formation of ultrafine crystal grains-depleted regions 15. A higher peripheral speed of the cooling roll 2 provides a higher cooling speed of the ribbon 1, promoting the formation of ultrafine crystal grains-depleted regions 15. When an ultrafine-crystalline alloy ribbon 1 of 10-40 μm in thickness and 5-250 mm in width is formed by a single-roll method, the peripheral speed of the cooling roll 2 having a width meeting the above condition is preferably 15-50 m/second, more preferably 20-40 m/second.

(6) Peeling Temperature

With an inert gas (nitrogen, etc.) blown from a nozzle to a gap between an ultrafine-crystalline alloy ribbon obtained by quenching and the cooling roll, the ribbon is peeled from the cooling roll. The peeling temperature (correlated with the cooling time) of the ribbon also affects the volume fraction of ultrafine crystal grains. The peeling temperature of the ribbon, which can be adjusted by changing the position of a nozzle blowing an inert gas (peeling position), is generally 170-350° C., preferably 200-340° C., more preferably 250-330° C. With the peeling temperature of lower than 170° C., the ribbon is excessively quenched, making the alloy structure substantially amorphous. On the other hand, when the peeling temperature is higher than 350° C., crystallization by Cu proceeds excessively, making the ribbon too brittle. With a proper cooling speed, ultrafine crystal grains are not formed in a ribbon surface region with a reduced amount of Cu by quenching, but many ultrafine crystal grains are precipitated inside the ribbon by a relatively slow cooling speed.

The peeled ultrafine-crystalline alloy ribbon is wound directly around a reel by a synchronous winding machine in many cases. Because the temperature is relatively high inside the ribbon, the ribbon is desirably cooled sufficiently before winding to prevent further crystallization. For example, an inert gas (nitrogen, etc.) is preferably blown to the peeled ribbon to cool it to substantially room temperature, and the ribbon is then wound.

[3] Fine-Crystalline, Soft-Magnetic Alloy Ribbon

The ultrafine-crystalline alloy ribbon is heat-treated to obtain a fine-crystalline, soft-magnetic alloy ribbon having a structure, in which fine crystal grains having a body-centered cubic (bcc) structure and an average particle size of 60 nm or less are dispersed in a volume fraction of 30% or more, preferably 50% or more, in an amorphous phase. Of course, fine crystal grains have a larger average particle size than that of ultrafine crystal grains which are not subjected to the heat treatment. The average particle size of fine crystal grains is preferably 15-40 nm.

(1) Heat Treatment Method (a) High-Temperature, Short-Time Heat Treatment

The ultrafine-crystalline alloy ribbon of the present invention may be subjected to a high-temperature, high-speed heat treatment, by which the ribbon is heated to the highest temperature at a temperature-elevating speed of 100° C./minute or more, and kept at the highest temperature for 1 hour or less. An average temperature-elevating speed up to the highest temperature is preferably 100° C./minute or more. Because a temperature-elevating speed in a high-temperature region of 300° C. or higher largely affects the magnetic properties of the ribbon, the average temperature-elevating speed at 300° C. or higher is preferably 100° C./minute or more. The highest temperature in the heat treatment is preferably equal to or higher than $(T_{X2}-50)$° C., wherein $T_{X2}$ is a precipitation temperature of a compound, specifically 430° C. or higher. With the highest temperature of lower than 430° C., sufficient precipitation and growth of fine crystal grains do not occur. The upper limit of the highest temperature is preferably 500° C. ($T_{X2}$) or lower. Even if the highest temperature is kept for more than 1 hour, fine crystallization does not further proceed, resulting in low productivity. The keeping time of the highest temperature is preferably 30 minutes or less, more preferably 20 minutes or less, most preferably 15 minutes or less. Such high-temperature heat treatment can suppress the growth of crystal grains and the formation of a compound as long as it is conducted in a short period of time, resulting in low coercivity, an improved magnetic flux density in a low magnetic field, and reduced hysteresis loss.

(b) Low-Temperature, Long-Time Heat Treatment

Another heat treatment is a low-temperature, low-speed heat treatment, by which the ribbon is kept at the highest temperature of about 350° C. or higher and lower than 430° C. for 1 hour or more. From the aspect of mass production, the keeping time of the highest temperature is preferably 24 hours or less, more preferably 4 hours or less. To suppress increase in coercivity, an average temperature-elevating speed is preferably 0.1-200° C./minute, more preferably 0.1-100° C./minute. This heat treatment provides a fine-crystalline, soft-magnetic alloy ribbon having high squareness.

(c) Heat Treatment Atmosphere

Though a heat treatment atmosphere may be air, the oxygen concentration of the heat treatment atmosphere is preferably 6-18%, more preferably 8-15%, most preferably 9-13%, to form an oxide coating having a desired layer structure by diffusing Si, Fe, B and Cu toward the surface. The heat treatment atmosphere is preferably a mixed gas of an inert gas such as nitrogen, Ar, helium, etc., and oxygen. The dew point of the heat treatment atmosphere is preferably −30° C. or lower, more preferably −60° C. or lower.

(d) Heat Treatment in Magnetic Field

To provide the fine-crystalline, soft-magnetic alloy ribbon with good induction magnetic anisotropy by a heat treatment in a magnetic field, a magnetic field having sufficient intensity to saturate the soft-magnetic alloy is preferably applied, in a period in which the heat treatment temperature is 200° C. or higher (preferably 20 minutes or more), during temperature elevation, in a period in which the highest temperature is kept, and/or during cooling. Though different depending on the shape of the ribbon, the magnetic field intensity is preferably 8 kA/m or more, in any case where it is applied in a width direction of the ribbon (height direction in the case of an annular core) or in a longitudinal direction of the ribbon (circumferential direction in the case of an annular core). The magnetic field may be a DC magnetic field, an AC magnetic field, or a pulse magnetic field. The heat treatment in a magnetic field provides a fine-crystalline, soft-magnetic alloy ribbon having a high or low squareness ratio in a DC hysteresis loop. In the case of a heat treatment with no magnetic field, the fine-crystalline, soft-magnetic alloy ribbon has a moderate squareness ratio in a DC hysteresis loop.

(2) Surface Treatment

The fine-crystalline, soft-magnetic alloy ribbon may be provided with an oxide coating such as $SiO_2$, MgO, $Al_2O_3$, etc., if necessary. With a surface treatment during the heat treatment, the resultant oxide has a high bonding strength. A core of this ribbon may be impregnated with a resin, if necessary.

(3) Matrix Structure of Fine-Crystalline, Soft-Magnetic Alloy Ribbon

In the heat-treated amorphous matrix, fine crystal grains having an average particle size of 60 nm or less and a body-centered cubic (bcc) structure are dispersed at a volume fraction of 30% or more. When the average particle size of fine crystal grains exceeds 60 nm, the ribbon has poor soft-magnetic properties. When the volume fraction of fine crystal grains is less than 30%, the ribbon is too amorphous, having a low saturation magnetic flux density. The average particle size of fine crystal grains after the heat treatment is preferably 40 nm or less, more preferably 30 nm or less. The lower limit of the average particle size of fine crystal grains is generally 12 nm, preferably 15 nm, more preferably 18 nm. The volume fraction of fine crystal grains after the heat treatment is preferably 50% or more, more preferably 60% or more. With the average particle size of 60 nm or less and the volume fraction of 30% or more, the alloy ribbon has lower magnetostriction and better soft magnetic properties than those of Fe-based amorphous alloys. Though Fe-based amorphous alloy ribbons having the same composition have relatively large magnetostriction due to a magnetic volume effect, the fine-crystalline, soft-magnetic alloy, in which bcc-Fe-based fine crystal grains are dispersed, has much smaller magnetostriction due to a magnetic volume effect, exhibiting a larger noise reduction effect.

[4] Magnetic Device

A magnetic device formed by the fine-crystalline, soft-magnetic alloy ribbon has a high saturation magnetic flux density, suitable for high-power applications in which it is important to avoid magnetic saturation. Such applications include, for example, large-current reactors such as anode reactors; choke coils for active filters; smoothing choke coils; pulse power magnetic devices used in laser power supplies, accelerators, etc.; cores for transformers, communications pulse transformers, motors and power generators; yokes; current sensors; magnetic sensors; antenna cores; electromagnetic wave-absorbing sheets, etc. Pluralities of alloy ribbons may be laminated and wound to form step-lapped or overlapped cores for transformers.

The present invention will be explained in more detail by Examples below without intention of restricting the present invention thereto. In each Example and Comparative Example, the peeling temperature of a ribbon, the average particle size, volume fraction number and density of fine crystal grains, and the distance of cutting without fracture from a side by scissors (cutting fracture test) were measured by the following methods.

(1) Measurement of Peeling Temperature of Ribbon

The temperature of an ultrafine-crystalline alloy ribbon when it was peeled from the cooling roll by a nitrogen gas blown from a nozzle was measured as a peeling temperature by a radiation thermometer (FSV-7000E available from Apiste).

(2) Measurement of Average Particle Size and Volume Fraction of Fine Crystal Grains The average particle size of fine crystal grains (and ultrafine crystal grains) was determined by measuring the major diameters $D_L$ and minor diameters $D_S$ of arbitrarily selected fine crystal grains in the number of n (30 or more) on a transmission electron photomicrograph (TEM photograph), etc. of each sample, and averaging them by the formula of $\Sigma(D_L+D_S)/2n$. Also, with an arbitrary straight line (length: Lt) drawn on a TEM photograph, etc. of each sample, the total length Lc of portions of fine crystal grains crossing the straight line was measured to calculate the percentage of crystal grains $L_L$ (=Lc/Lt) along the straight line. This operation was repeated on five straight lines, and the resultant data of $L_L$ were averaged to determine the volume fraction of fine crystal grains. The volume fraction $V_L$=Vc/Vt, wherein Vc was the total volume of fine crystal grains, and Vt was the volume of a sample, was approximated to $V_L \sim Lc^3/Lt^3 = L_L^3$.

(3) Measurement of Number Density of Ultrafine Crystal Grains

On TEM photographs (magnification: 20,000 times) of a 0.2-mm-wide ultrafine crystal grains-depleted region extending from a side of each ribbon surface and a center portion of the ribbon, the number of ultrafine crystal grains having particle sizes of 3 nm or more, which were confirmable by the naked eye, was counted, to calculate the number density $\rho_{0.2}$ of ultrafine crystal grains per a unit area ($\mu m^2$) in the ultrafine crystal grains-depleted region, and the number density $\rho_c$ of ultrafine crystal grains per a unit area ($\mu m^2$) in the center portion.

(4) Cutting Fracture Test

Though brittle fracture does not occur when an amorphous phase is cut by scissors, brittle fracture occurs when a phase containing ultrafine crystal grains is cut by scissors. Accordingly, when an ultrafine-crystalline alloy ribbon is cut by scissors, the width of an ultrafine crystal grains-depleted region can be presumed from the distance of fracture from a side of the ribbon. Thus, 10 side portions of an ultrafine-crystalline alloy ribbon were cut by scissors to measure fracture distances from the side. With their averaged value $r_c$, the width of the ultrafine crystal grains-depleted region was evaluated by the following standard.

Excellent: Fracture did not occur up to a distance $r_c$ of 0.2 mm from the side in all cut portions.

Good: Fracture occurred at a distance $r_c$ of 0.1-0.2 mm from the side in at least one cut portion.

Poor: Fracture occurred at a distance $r_c$ of less than 0.1 mm from the side in at least one cut portion.

(6) Measurement of DC Magnetic Properties

A 120-mm single plate sample was measured with respect to a magnetic flux density $B_{80}$ at 80 A/m and a magnetic flux density $B_{8000}$ at 8000 A/m (substantially equal to a saturation magnetic flux density Bs) by an automatic DC magnetization recorder (available from Metron, Inc.), to determine a ratio of $B_{80}/B_{8000}$.

EXAMPLE 1

An alloy melt (1300° C.) having a composition of $Fe_{bal}Cu_{1.4}Si_5B_{13}$ (atomic %) was quenched in the air, by a single-roll method using a copper-alloy-made cooling roll (width: 168 mm, peripheral speed: 27 m/s, temperature of entering cooling water: about 60° C., temperature of exiting cooling water: about 70° C.), with a gap of 200 μm between a nozzle and the cooling roll, and the resultant ultrafine-crystalline alloy ribbon of 25 mm in width, about 23 μm in thickness and about 10 km in length was peeled at a temperature of 250° C. from the cooling roll, and wound without fracture. A melt-ejecting position was substantially in a center portion of the cooling roll, with as sufficiently large distance as about 72 mm between a side of the ribbon and a side of the cooling roll.

Figure 7:
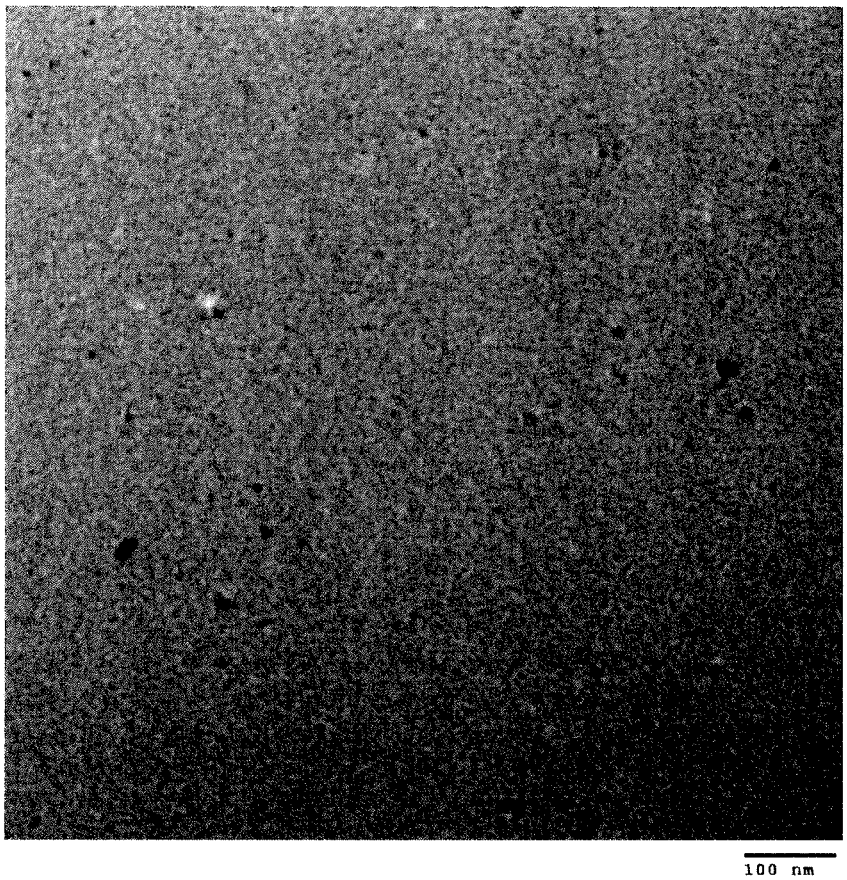
FIG. 7 is a transmission electron photomicrograph showing the microstructure of a side portion of an ultrafine-crystalline alloy ribbon formed in Example 1.
Figure 8:
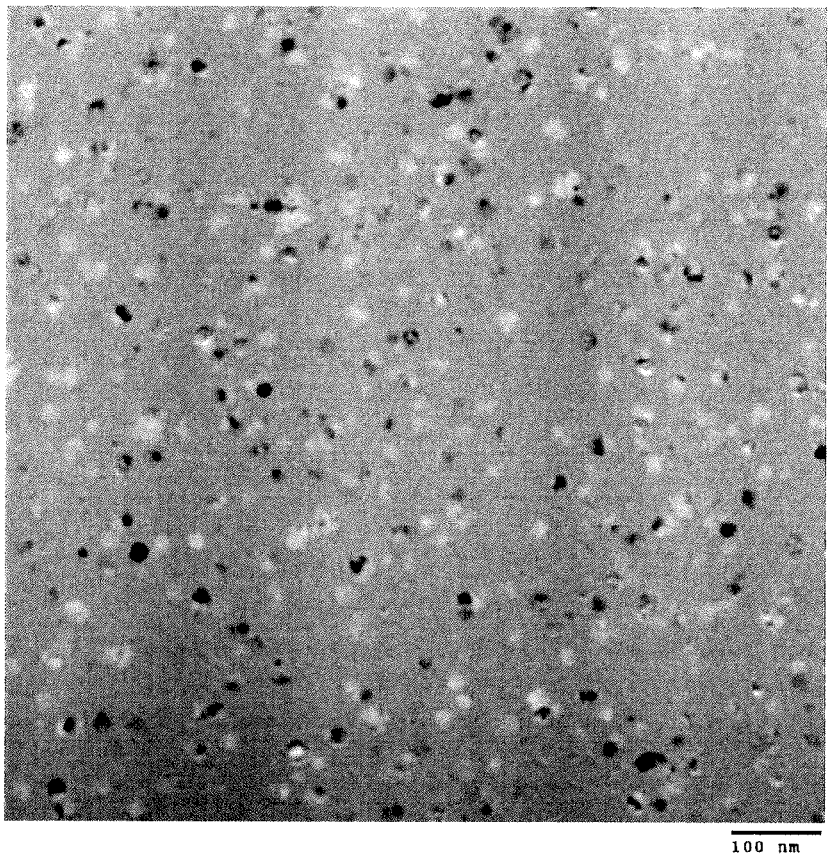
FIG. 8 is a transmission electron photomicrograph showing the microstructure of a center portion of an ultrafine-crystalline alloy ribbon formed in Example 1.

FIG. 7 is a TEM photograph (magnification: 20,000 times) showing the structure of an ultrafine crystal grains-depleted region having a width of 0.2 mm from one side of the ribbon, and FIG. 8 is a TEM photograph (magnification: 20,000 times) showing the structure of a center portion of the ribbon. In arbitrary fields of the TEM photographs of FIGS. 7 and 8, the number of ultrafine crystal grains (3 nm or more) observed by the naked eye was counted. It was thus found that in the ultrafine crystal grains-depleted region, ultrafine crystal grains had an average particle size of about 5 nm and a number density of 100/$\mu m^2$ or less. Accordingly, it may be said that the ultrafine crystal grains-depleted region is substantially amorphous. Of course, in an ultrafine crystal grains-depleted region on the other side of the ribbon, the number density of ultrafine crystal grains was also 100/$\mu m^2$ or less. On the other hand, ultrafine crystal grains had an average particle size of about 10 nm and a number density of about 1000/$\mu m^2$ in a center portion of the ribbon. This number density corresponds to 10% by volume.

As a result of rewinding the cooled ribbon by the same apparatus and conditions as conventional ones, the ribbon was not fractured even after contact with flanges of a winding reel. It is considered that the toughness of ultrafine crystal grains-depleted regions on both sides contributed to improving the fracture resistance of the ribbon.

COMPARATIVE EXAMPLE 1

Figure 9:
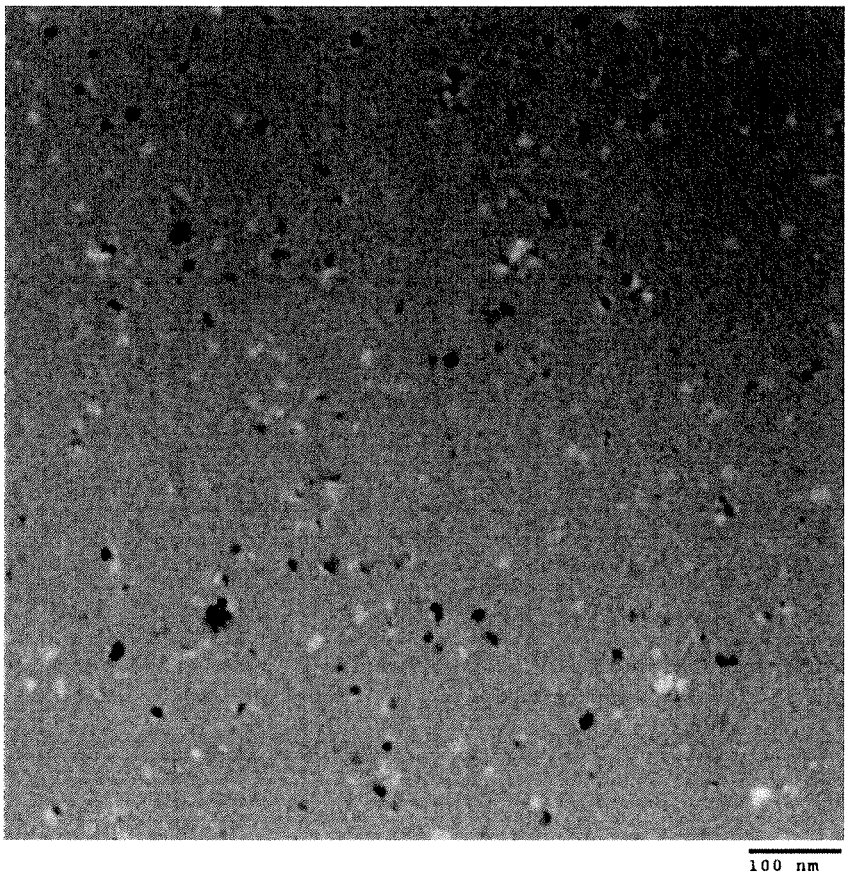
FIG. 9 is a transmission electron photomicrograph showing the microstructure of a side portion of an ultrafine-crystalline alloy ribbon formed in Comparative Example 1.

A ribbon was produced from the same alloy melt under the same conditions as in Example 1, except that a melt-ejecting position was shifted toward one side to have a distance S of about 30 mm between a side of the ribbon and a side of the cooling roll. Fracture did not occur by winding during the melt ejection. FIG. 9 is a TEM photograph showing the structure of a 0.2-mm-wide region extending from one side of the ribbon. As is clear from FIG. 9, the number density of ultrafine crystal grains having particle sizes of 3 nm or more in this region was about 500/$\mu m^2$. There were also many clusters of ultrafine crystal grains of about 5 nm. Accordingly, the above region was not regarded as an ultrafine crystal grains-depleted region. Ultrafine crystal grains having an average particle size of 12 nm were formed in the number of 1000/$\mu m^2$ in a center portion of the ribbon.

When the cooled ribbon was rewound in the same manner as in Example 1, the ribbon was fractured several times by contact with flanges of a winding reel. This appears to be due to the fact that good ultrafine crystal grains-depleted regions were not formed in both side portions of the ribbon.

EXAMPLES 2-12 AND COMPARATIVE EXAMPLES 2-5

Each alloy melt (1300° C.) having a composition of $Fe_{bal.}Cu_{1.3}Si_4B_{14}$ (atomic %) shown in Table 1 was quenched in the air by a single-roll method using a copper-alloy-made cooling roll (width: 168 mm or 280 mm, peripheral speed: 23-36 m/s, temperature of entering cooling water: 25-60° C., temperature of exiting cooling water: 30-70° C.), with a gap of 180-250 μm between a nozzle and the cooling roll. In this case, with a melt-ejecting position on the cooling roll changed, a distance S (shorter one) between a side of the ribbon and a side of the cooling roll was changed as shown in FIG. 5. The ribbon was peeled from the cooling roll at a temperature of 250° C. to obtain an ultrafine-crystalline alloy ribbon of 5-100 mm in width and about 23 μm in thickness. Every ribbon was as thick as 23 μm by gap adjustment. It was confirmed that each ultrafine-crystalline alloy ribbon had a structure, in which ultrafine crystal grains having an average particle size of 30 nm or less were dispersed in a proportion of 30% or less by volume in an amorphous matrix.

With respect to each ribbon of Examples 1-12 and Comparative Examples 1-5, the number density $\rho_{0.2}$ of ultrafine crystal grains having particle sizes of 3 nm or more in a 0.2-mm-wide region extending from a side, and the number density $\rho_c$ of ultrafine crystal grains having particle sizes of 3 nm or more in a center portion were measured.

Because a higher number density of ultrafine crystal grains provides a ribbon with higher Vickers hardness, a position at which the number density of ultrafine crystal grains was ½ of the number density $\rho_c$ of ultrafine crystal grains in a center portion (expressed by a distance $r_{1/2}$ from a side) was determined from the Vickers hardness distribution of the ribbon in a width direction.

The cooled ribbon was rewound around a reel having flanges, to examine the number v of fracture (the number of winding after fracture and reconnection) per a unit length (1 km) of the ribbon. If the number of fracture were 5 or less, production efficiency would be little influenced. The wound ribbon was subjected to a cutting fracture test, to measure a fracture-free cutting distance by scissors from a side.

A 120-mm-long, single-plate sample obtained from each ultrafine-crystalline alloy ribbon was charged into a heat treatment furnace, and subjected to a low-temperature, long-time heat treatment comprising heating to 410° C. over about 15 minutes and keeping that temperature for 1 hour, thereby forming a fine-crystalline, soft-magnetic alloy ribbon. With respect to each fine-crystalline, soft-magnetic alloy ribbon, the average particle size and volume fraction of fine crystal grains were measured. As a result, it was confirmed that the fine-crystalline, soft-magnetic alloy ribbon had a structure comprising fine crystal grains having an average particle size of 60 nm or less dispersed in a proportion of 30% or more by volume.

Each single-plate sample was measured with respect to $B_{80}/B_{8000}$. The results of the above measurements are shown in Table 1.

TABLE 1

| No. | Alloy Composition (atomic %) | Gap[1] (μm) | Ribbon Width W (mm) | Roll width L (mm) | Distance S (mm) |
|---|---|---|---|---|---|
| Example 2 | $Fe_{bal.}Cu_{1.4}Si_5B_{13}$ | 180 | 25 | 168 | 70 |
| Example 3 | $Fe_{bal.}Cu_{1.3}Si_4B_{14}$ | 190 | 25 | 168 | 65 |
| Example 4 | $Fe_{bal.}Cu_{1.3}Si_4B_{14}$ | 200 | 50 | 168 | 60 |
| Example 5 | $Fe_{bal.}Cu_{1.3}Si_4B_{14}$ | 210 | 50 | 168 | 50 |
| Example 6 | $Fe_{bal.}Cu_{1.3}Si_4B_{14}$ | 220 | 75 | 168 | 45 |
| Example 7 | $Fe_{bal.}Cu_{1.3}Si_4B_{14}$ | 220 | 75 | 168 | 35 |
| Example 8 | $Fe_{bal.}Cu_{1.3}Si_4B_{14}$ | 250 | 100 | 280 | 70 |
| Example 9 | $Fe_{bal.}Cu_{1.3}Si_4B_{14}$ | 190 | 50 | 280 | 115 |
| Example 10 | $Fe_{bal.}Cu_{1.3}Si_4B_{14}$ | 180 | 25 | 280 | 50 |
| Example 11 | $Fe_{bal.}Cu_{1.3}Si_4B_{14}$ | 180 | 10 | 280 | 135 |
| Example 12 | $Fe_{bal.}Cu_{1.3}Si_4B_{14}$ | 190 | 10 | 168 | 70 |
| Com. Ex. 2 | $Fe_{bal.}Cu_{1.3}Si_4B_{14}$ | 220 | 60 | 168 | 10 |
| Com. Ex. 3 | $Fe_{bal.}Cu_{1.3}Si_4B_{14}$ | 190 | 25 | 168 | 15 |
| Com. Ex. 4 | $Fe_{bal.}Cu_{1.3}Si_4B_{14}$ | 200 | 50 | 280 | 25 |
| Com. Ex. 5 | $Fe_{bal.}Cu_{1.3}Si_4B_{14}$ | 250 | 100 | 168 | 30 |

Note:
[1]The gap between the nozzle and the cooling roll.

| No. | Number Density (/μm²) $\rho_{0.2}$[1] | $\rho_c$[2] | $r_{1/2}$ (mm) | Number of Fracture fracture (/km) | Position $r_c$ | $B_{80}/B_{8000}$ |
|---|---|---|---|---|---|---|
| Example 2 | 100 | 500 | 0.5 | 0 | Excellent | 0.92 |
| Example 3 | 100 | 600 | 0.6 | 0 | Excellent | 0.92 |
| Example 4 | 150 | 800 | 0.5 | 0 | Excellent | 0.93 |
| Example 5 | 300 | 850 | 0.5 | 0 | Excellent | 0.95 |
| Example 6 | 400 | 1000 | 0.4 | 3 | Good | 0.95 |
| Example 7 | 450 | 1200 | 0.3 | 5 | Good | 0.95 |
| Example 8 | 200 | 900 | 0.4 | 2 | Good | 0.96 |
| Example 9 | 100 | 800 | 0.5 | 0 | Excellent | 0.93 |
| Example 10 | 50 | 800 | 0.6 | 0 | Excellent | 0.92 |
| Example 11 | 0 | 200 | 1.5 | 0 | Excellent | 0.72 |
| Example 12 | 0 | 700 | 1 | 0 | Excellent | 0.83 |
| Com. Ex. 2 | 600 | 1000 | 0.1 | 25 | Poor | 0.96 |
| Com. Ex. 3 | 500 | 900 | 0.1 | 22 | Poor | 0.95 |
| Com. Ex. 4 | 500 | 800 | 0.1 | 18 | Poor | 0.96 |
| Com. Ex. 5 | 700 | 1200 | 0.1 | 33 | Poor | 0.96 |

Note:
[1] The number density of ultrafine crystal grains having particle sizes of 3 nm or more in a 0.2-mm-wide ultrafine crystal grains-depleted region extending from a side of the ribbon.
[2] The number density of ultrafine crystal grains having particle sizes of 3 nm or more in a center portion of the ribbon.

It was confirmed that in Examples 2-12, ultrafine crystal grains-depleted regions (substantially amorphous) were formed in a range of 0.2 mm from both sides of the ribbon. The results of Examples 2-10 indicate that ribbons comprising ultrafine crystal grains-depleted regions containing ultrafine crystal grains at number densities $\rho_{0.2}$ of less than 500 $\mu m^2$ in regions of 0.2 mm from both sides could be rewound without fracture, and if any, the number of fracture was within 5, resulting in good operation efficiency. Also, fracture seldom occurred in the cutting fracture test, indicating high toughness. Even in Examples in which cutting of 0.2 mm or more could be made in the cutting fracture test, the width of the ultrafine crystal grains-depleted region was within 5% of the entire width of the ribbon. Examples in which cutting of 0.1-0.2 mm could be made exhibited relatively good ratios of $B_{80}/B_{8000}$ despite several numbers of fracture. It was found that with ultrafine crystal grains-depleted regions of 0.1 mm or more in width, fracture could be extremely reduced at the time of rewinding.

In Examples 11 and 12, complete amorphous phases were formed on both sides, resulting in no fracture when rewound. However, the positions of fracture exceeded 5% of the entire width, resulting in regions having coarse crystal grains after the heat treatment, and relatively low ratios of $B_{80}/B_{8000}$. However, this does not particularly cause any problems in high-frequency applications such as choke coils, reactors, etc.

It was confirmed that the heat-treated structure was a structure, in which fine crystal grains having an average particle size of about 40-60 nm were dispersed in a proportion of about 50% by volume in an amorphous matrix at position of 0.2 mm from a side of the ribbon, the average crystal particle size being larger in side portions corresponding to the ultrafine crystal grains-depleted regions than in a center portion. This appears to be due to the fact that grain growth was more promoted by a heat treatment in side portions having a small number density (low density).

Regions having larger particle sizes were not wider than the ultrafine crystal grains-depleted regions. Because coarse crystal grains affect coercivity, the regions having larger particle sizes should have the same structure of the center portion, preferably within 5% of the entire width at least like the ultrafine crystal grains-depleted regions.

In any of Comparative Examples 2-5, the number density of ultrafine crystal grains $\rho_{0.2}$ in a 0.2-mm-wide region extending from a side was 500/μm$^2$ or more, indicating that necessary ultrafine crystal grains-depleted regions were not formed. As a result, several tens of fracture occurred in rewinding, failing to conduct efficient winding. Also, fracture occurred in a short distance of cutting in the cutting fracture test, and the distance $r_{1/2}$ was about 0.1 mm presumably by the brittleness of ultrafine crystal grains. This appears to be due to the fact that because there was no sufficient distance S between a side of the ribbon and a side of the cooling roll, or because the ribbon was too wide relative to the cooling roll, heat conduction with proper side cooling could not be achieved.

EXAMPLES 13-40

Each alloy melt (1300° C.) having a composition (atomic %) shown in Table 2 was quenched in the air by a single-roll method using a copper-alloy-made cooling roll (width: 168 mm or 280 mm, peripheral speed: 23-36 m/s, temperature of entering cooling water: 25-60° C., temperature of exiting cooling water: 30-70° C.), with a gap of 180-250 μm between a nozzle and the cooling roll. By changing a melt-ejecting position on the cooling roll, a distance S (shorter one) between a side of the ribbon and a side of the cooling roll was changed as shown in FIG. 5. The distance S between a side of each ultrafine-crystalline alloy ribbon and a side of the cooling roll is shown in Table 2. The ribbon was peeled from the cooling roll at a temperature of 250° C., to obtain an ultrafine-crystalline alloy ribbon of 25-100 mm in width and about 23 μm in thickness. It was confirmed that each ultrafine-crystalline alloy ribbon had a structure comprising ultrafine crystal grains having an average particle size of 30 nm or less dispersed in a proportion of 30% or less by volume in an amorphous matrix. It was also confirmed that ultrafine crystal grains-depleted regions, in which the number density of ultrafine crystal grains was less than 500/μm$^2$, were formed in 0.2-mm-wide regions extending from both sides of each ultrafine-crystalline alloy ribbon.

The cooled ribbon was rewound around a reel having flanges, to examine the number v of fracture (the number of winding after fracture and reconnection) per a unit length (1 km) of the ribbon. If the number of fracture were 5 or less, production efficiency would be little influenced. Each ultrafine-crystalline alloy ribbon was subjected to a cutting fracture test, to measure a fracture-free cutting distance $r_c$ by scissors from a side.

A 120-mm-long, single-plate sample obtained from each ultrafine-crystalline alloy ribbon was charged into a heat treatment furnace, and subjected to a low-temperature, long-time heat treatment comprising heating to 410° C. over about 15 minutes and keeping that temperature for 1 hour, thereby forming a fine-crystalline, soft-magnetic alloy ribbon. With respect to each fine-crystalline, soft-magnetic alloy ribbon, the average particle size and volume fraction of fine crystal grains were measured. As a result, it was confirmed that the fine-crystalline, soft-magnetic alloy ribbon had a structure comprising fine crystal grains having an average particle size of 60 nm or less dispersed in a proportion of 30% or more by volume.

A single-plate sample of each fine-crystalline, soft-magnetic alloy ribbon was measured with respect to $B_{80}/B_{8000}$. The results of the above measurements are shown in Table 2.

TABLE 2

| No. | Composition (atomic %) | Width W of Ribbon (mm) | Roll width L (mm) | Distance S (mm) |
|---|---|---|---|---|
| Example 13 | $Fe_{bal.}Cu_{1.3}Si_5B_{13}$ | 50 | 168 | 50 |
| Example 14 | $Fe_{bal.}Cu_{1.2}Si_3B_{15}$ | 50 | 168 | 55 |
| Example 15 | $Fe_{bal.}Cu_{1.25}Si_2B_{15}$ | 50 | 168 | 55 |
| Example 16 | $Fe_{bal.}Cu_{1.4}Si_4B_{13}$ | 50 | 168 | 55 |
| Example 17 | $Fe_{bal.}Cu_{1.35}Si_4B_{13}$ | 50 | 168 | 55 |
| Example 18 | $Fe_{bal.}Cu_{1.25}Si_1B_{17}$ | 50 | 168 | 55 |
| Example 19 | $Fe_{bal.}Cu_{1.4}Si_6B_{12}$ | 50 | 280 | 70 |
| Example 20 | $Fe_{bal.}Cu_{1.3}Si_2B_{16}$ | 100 | 280 | 70 |
| Example 21 | $Fe_{bal.}Cu_{1.25}Si_2B_{14}$ | 25 | 168 | 70 |
| Example 22 | $Fe_{bal.}Cu_{1.45}Si_7B_{12}$ | 25 | 168 | 70 |
| Example 23 | $Fe_{bal.}Cu_{1.6}Si_7B_{12}$ | 25 | 168 | 70 |
| Example 24 | $FC_{bal.}Cu_{1.1}Si_3B_{18}$ | 25 | 168 | 70 |
| Example 25 | $Fe_{bal.}Cu_{1.2}Si_4B_{17}$ | 25 | 168 | 70 |
| Example 26 | $Fe_{bal.}Cu_{1.4}Si_7B_{11}$ | 25 | 168 | 70 |
| Example 27 | $Fe_{bal.}Cu_{1.4}Si_5B_{12}$ | 25 | 168 | 70 |
| Example 28 | $Fe_{bal.}Cu_{1.3}Si_3B_{13}$ | 25 | 168 | 70 |
| Example 29 | $Fe_{bal.}Cu_{1.3}Si_3B_{14}$ | 25 | 168 | 70 |
| Example 30 | $Fe_{bal.}Cu_{1.4}Si_3B_{14}$ | 25 | 168 | 70 |
| Example 31 | $Fe_{bal.}Cu_{1.3}B_{15}$ | 25 | 168 | 70 |
| Example 32 | $Fe_{bal.}Cu_{1.25}B_{16}$ | 25 | 168 | 70 |
| Example 33 | $Fe_{bal.}Cu_{1.25}B_{17}$ | 25 | 168 | 70 |
| Example 34 | $FC_{bal.}Cu_{1.2}B_{18}$ | 25 | 168 | 70 |
| Example 35 | $Fe_{bal.}Cu_{1.4}Si_2B_{12}P_2$ | 25 | 168 | 70 |
| Example 36 | $Fe_{bal.}Cu_{1.5}Si_2B_{10}P_4$ | 25 | 168 | 70 |
| Example 37 | $Fe_{bal.}Cu_{1.6}Si_8B_{10}$ | 25 | 168 | 70 |
| Example 38 | $Fe_{bal.}Cu_{1.4}Si_6B_{11}$ | 25 | 168 | 70 |
| Example 39 | $Fe_{bal.}Cu_{1.25}Si_4B_{13}Ag_{0.05}$ | 25 | 168 | 70 |
| Example 40 | $Fe_{bal.}Cu_{1.28}Si_4B_{13}Sn_{0.05}$ | 25 | 168 | 70 |
| Example 41 | $Fe_{bal.}Ni_{0.5}Cu_{1.35}Si_{3.5}B_{14}$ | 50 | 168 | 55 |
| Example 42 | $Fe_{bal.}Ni_1Cu_{1.4}Si_6B_{12}$ | 50 | 168 | 55 |
| Example 43 | $Fe_{bal.}Cu_{1.4}B_{12}P_4$ | 50 | 168 | 55 |
| Example 44 | $Fe_{bal.}Cu_{1.5}B_{10}P_6$ | 50 | 168 | 55 |
| Example 45 | $Fe_{bal.}Cu_{1.4}Si_6B_{11}$ | 50 | 168 | 55 |
| Example 46 | $Fe_{bal.}Cu_{1.2}Si_2B_8P_8$ | 50 | 168 | 55 |
| Example 47 | $Fe_{bal.}Cu_{1.0}Au_{0.25}Si_1B_{15}$ | 50 | 168 | 55 |

| No. | Number of Fracture v (/km) | Fracture Position $r_c$ | $B_{80}/B_{8000}$ |
|---|---|---|---|
| Example 13 | 0 | Excellent | 0.94 |
| Example 14 | 0 | Excellent | 0.93 |
| Example 15 | 2 | Good | 0.93 |
| Example 16 | 0 | Excellent | 0.93 |
| Example 17 | 0 | Excellent | 0.94 |
| Example 18 | 3 | Good | 0.94 |
| Example 19 | 0 | Excellent | 0.93 |
| Example 20 | 3 | Good | 0.95 |
| Example 21 | 0 | Excellent | 0.93 |
| Example 22 | 0 | Excellent | 0.92 |
| Example 23 | 0 | Excellent | 0.90 |
| Example 24 | 0 | Excellent | 0.92 |
| Example 25 | 0 | Excellent | 0.91 |
| Example 26 | 0 | Excellent | 0.93 |
| Example 27 | 0 | Excellent | 0.93 |
| Example 28 | 0 | Excellent | 0.92 |
| Example 29 | 0 | Excellent | 0.92 |
| Example 30 | 0 | Excellent | 0.92 |
| Example 31 | 0 | Excellent | 0.93 |
| Example 32 | 0 | Excellent | 0.94 |
| Example 33 | 0 | Excellent | 0.94 |
| Example 34 | 0 | Excellent | 0.92 |
| Example 35 | 0 | Excellent | 0.92 |
| Example 36 | 0 | Excellent | 0.91 |
| Example 37 | 0 | Excellent | 0.93 |
| Example 38 | 0 | Excellent | 0.93 |
| Example 39 | 0 | Excellent | 0.95 |
| Example 40 | 0 | Excellent | 0.95 |
| Example 41 | 0 | Excellent | 0.91 |

TABLE 2-continued

| | | | |
|---|---|---|---|
| Example 42 | 0 | Excellent | 0.92 |
| Example 43 | 0 | Good | 0.90 |
| Example 44 | 0 | Excellent | 0.90 |
| Example 45 | 0 | Good | 0.91 |
| Example 46 | 0 | Excellent | 0.91 |
| Example 47 | 0 | Excellent | 0.94 |

As shown in Table 2, the number of fracture in rewinding was within an acceptable range with good $B_{80}/B_{8000}$ in any Example. This appears to be due to the fact that with a preferred heat conduction model obtained in the production of the ribbon, suitable ultrafine crystal grains-depleted regions were formed in both side portions of the ribbon.

The composition of the alloy is not restricted to those in Examples above, but may be within the present invention as long as non-uniform ultrafine crystallization can be achieved in an amorphous matrix.

EFFECTS OF THE INVENTION

Because an ultrafine crystal grains-depleted region having a smaller number density of ultrafine crystal grains than in a center portion of the ribbon is formed in each side portion, and because the ultrafine crystal grains-depleted region has toughness closer to that of an amorphous phase, the ultrafine-crystalline alloy ribbon of the present invention exhibits high fracture resistance when wound or rewound. As a result, the ultrafine-crystalline alloy ribbon is less broken or fractured in handling such as cutting, winding, etc., so that it can be stably mass-produced.

What is claimed is:

1. An ultrafine-crystalline alloy ribbon having a structure, in which more than 0% and less than 30% by volume of ultrafine crystal grains having an average particle size of 30 nm or less are dispersed in an amorphous matrix; an ultrafine crystal grains-depleted region having a smaller number density of ultrafine crystal grains than in a center portion of said ribbon being formed in a region of 0.2 mm in width from each edge of the ribbon along a longitudinal direction; and the number density of ultrafine crystal grains having particle sizes of 3 nm or more being $300/\mu m^2$ or less in said ultrafine crystal grains-depleted region, and $500/\mu m^2$ or more in the center portion of said ribbon, wherein a distance between said edge and a position at which a number density of ultrafine crystal grains is ½ of a number density of ultrafine crystal grains in said center portion is 0.5 to 0.6 mm, the distance being 1 to 2.4% of the entire width of said ultrafine-crystalline alloy ribbon, wherein the total width of both ultrafine crystal grains-depleted regions is 5% or less of the entire width of said ultrafine-crystalline alloy ribbon, and wherein said ultrafine-crystalline alloy ribbon is made of a magnetic alloy having a composition represented by the general formula of $Fe_{100-x-y-z}A_xB_yX_z$, wherein A is Cu and/or Au, X is at least one element selected from the group consisting of Si, S, C, P, Al, Ge, Ga and Be, part of Fe may be substituted by at least one element D selected from the group consisting of Ni, Mn, Co, V, Cr, Ti, Zr, Nb, Mo, Hf, Ta, and W, part of Fe may be substituted by at least one element selected from the group consisting of Re, Y, Zn, As, Ag, In, Sn, Sb, platinum-group elements, Bi, N, O, and rare earth elements, and x, y and z are numbers meeting the conditions of $0<x\leq5$, $8\leq y\leq22$, $0\leq z\leq10$, and $x+y+z\leq25$ by atomic %.

2. The ultrafine-crystalline alloy ribbon according to claim 1, wherein part of Fe is substituted by at least one element D selected from the group consisting of Ni, Mn, Co, V, Cr, Ti, Zr, Nb, Mo, Hf, Ta and W.

3. The ultrafine-crystalline alloy ribbon according to claim 1, wherein part of Fe is substituted by at least one element selected from the group consisting of Re, Y, Zn, As, Ag, In, Sn, Sb, platinum-group elements, Bi, N, O, and rare earth elements.

4. A fine-crystalline, soft-magnetic alloy ribbon obtained by heat-treating the ultrafine-crystalline alloy ribbon recited in claim 1, which has a structure in which 30% or more by volume of fine crystal grains having an average particle size of 60 nm or less are dispersed in an amorphous matrix; grain-grown regions comprising fine crystal grains having larger particle sizes than said average particle size being formed in both side portions; and the total width of both grain-grown regions being 5% or less of the entire width of said fine-crystalline, soft-magnetic alloy ribbon, wherein the width of each grain-grown region is 0.2% or more of the entire width of said fine-crystalline, soft-magnetic alloy ribbon.

5. A magnetic device comprising the fine-crystalline, soft-magnetic alloy ribbon recited in claim 4.

6. The fine-crystalline, soft-magnetic alloy ribbon according to claim 4, wherein each grain-grown region is formed in a region of 0.2 mm in width in each side portion of said fine-crystalline, soft-magnetic alloy ribbon.

* * * * *